US010334911B2

(12) United States Patent
Sixt et al.

(10) Patent No.: US 10,334,911 B2
(45) Date of Patent: Jul. 2, 2019

(54) BUCKLE

(71) Applicant: Lindnerhof-Taktik GmbH, Lenggries (DE)

(72) Inventors: Josef Sixt, Lenggries (DE); Martin Schwager, Pentzberg (DE)

(73) Assignee: Lindnerhof-Taktik GmbH, Lenggries (DE)

( * ) Notice: Subject to any disclaimer, the term of this patent is extended or adjusted under 35 U.S.C. 154(b) by 277 days.

(21) Appl. No.: 15/346,497

(22) Filed: Nov. 8, 2016

(65) Prior Publication Data

US 2017/0127766 A1 May 11, 2017

(30) Foreign Application Priority Data

Nov. 9, 2015 (DE) ..... 10 2015 014 471

(51) Int. Cl.

| | |
|---|---|
| ***A44B 11/25*** | (2006.01) |
| ***A41D 1/04*** | (2006.01) |
| ***A44B 11/00*** | (2006.01) |
| ***A44B 11/28*** | (2006.01) |
| ***F41H 1/02*** | (2006.01) |
| ***A41F 1/00*** | (2006.01) |

(52) U.S. Cl.

CPC ..... *A44B 11/2584* (2013.01); *A41D 1/04* (2013.01); *A41F 1/00* (2013.01); *A44B 11/008* (2013.01); *A44B 11/28* (2013.01); *F41H 1/02* (2013.01); *A41D 2300/30* (2013.01)

(58) Field of Classification Search

CPC ..... Y10T 24/45037; Y10T 24/45016; Y10T 24/45058; Y10T 24/45063; Y10T 24/45529; A44B 11/2584; A44B 11/28; F41H 1/02

See application file for complete search history.

(56) References Cited

U.S. PATENT DOCUMENTS

| | | | |
|---|---|---|---|
| 3,293,714 | A | 12/1966 | Shafer |
| 4,682,389 | A | 7/1987 | Callendar |

(Continued)

FOREIGN PATENT DOCUMENTS

| | | | |
|---|---|---|---|
| DE | 2901252 | A1 | 7/1980 |
| DE | 3736254 | A1 | 5/1989 |

(Continued)

*Primary Examiner* — Robert Sandy

(74) *Attorney, Agent, or Firm* — Husch Blackwell LLP

(57) ABSTRACT

A buckle for releasable load coupling of two elements, the buckle includes a first and a second buckle component. Each of the buckle components may have a connection area via which one of the elements is connectable to the buckle component, and a coupling area wherein the buckle components can be coupled to one another in a form-fit manner. The buckle components may be releasably locked to one another at the coupled position by a locking element. Each of the coupling areas of the buckle components may be defined by a hook profile extending in the width direction. The hook profiles of the buckle components may be configured as complementary elements and interengage at the coupled position of the buckle components. One embodiment includes using the buckle to couple two elements on an object that can be worn on the human body, and in some cases, a ballistic vest.

19 Claims, 8 Drawing Sheets

(56) References Cited

U.S. PATENT DOCUMENTS

| | | | | |
|---|---|---|---|---|
| 5,224,247 | A * | 7/1993 | Collier | A44B 11/28 24/587.12 |
| 5,664,298 | A | 9/1997 | Nessar-Ivanovic | |
| 7,047,570 | B2 | 5/2006 | Johnson | |
| 7,979,917 | B2 | 7/2011 | Osborne | |
| 7,987,523 | B2 | 8/2011 | Cole et al. | |
| 8,056,196 | B2 | 11/2011 | Sample et al. | |
| 9,144,255 | B1 * | 9/2015 | Perciballi | A41D 27/00 |

FOREIGN PATENT DOCUMENTS

| | | | |
|---|---|---|---|
| EP | 0923887 | A2 | 12/1998 |
| WO | 2013119294 | A1 | 8/2013 |

* cited by examiner section B-B section D-D section C-C section A-A

BUCKLE

CROSS-REFERENCE TO RELATED APPLICATION

This application claims the benefit of German Patent Application No. 10 2015 014 471.5 filed Nov. 9, 2015, the entire disclosure of which is hereby incorporated by reference.

FIELD OF THE INVENTION

The present invention relates to a buckle for releasable load coupling of two elements, in particular by means of two textile straps. In particular, the buckle according to the present invention may be used for an object that can be worn on the human body, in particular a ballistic vest.

BACKGROUND OF THE INVENTION

Such a buckle for a ballistic vest is known from reference WO 2013/119294 A1. The buckle comprises two buckle components, each having a connection area via which a textile strap is connectable to the buckle component, and a coupling area via which the buckle components can be coupled to one another in a form-fit manner. In addition, the buckle components are releasably locked to one another at the coupled position by means of a locking element. The respective connection area provided for connection to the textile straps is a bar around which the textile strap can be wrapped. One of the buckle components comprises as a coupling area a C-shaped clip, which extends in the width direction. The coupling area of the other buckle component is defined by a bar, which can be inserted into the C-shaped clip only from the side and which is connected to the connection area via a tab projecting from the open end of the C-shaped clip.

However, this buckle is comparatively difficult to operate and, in particular, difficult to open and close. In addition, the buckle has a comparatively long overall size, so that precious space gets lost, which could otherwise be utilized for fixing additional objects.

Therefore, there is a need in the art to provide a buckle that is easier to operate. Preferably, the buckle has the shortest possible overall size.

SUMMARY OF THE INVENTION

The present invention comprises a buckle for releasable load coupling of two elements, in particular for an object that can be worn on the human body, in particular a ballistic vest. The buckle comprises a first and a second buckle component, each of said buckle components having a connection area via which one of the elements is connectable to the buckle component, and a coupling area via which the buckle components can be coupled to one another in a form-fit manner. In addition, the buckle components are releasably locked to one another at the coupled position by means of a locking element. According to the present invention, each of the coupling areas of the buckle components is defined by a hook profile extending in the width direction, said hook profiles of the buckle components being configured as complementary elements and interengaging at the coupled position of the buckle components. Designing the coupling areas as hook profiles according to the present invention is advantageous insofar as the buckle can be opened and/or closed much easier. In addition, designing the coupling areas as hook profiles allows a very short overall size.

Preferably, the buckle can be closed by pushing the hook profiles into one another in the load direction and/or opened by pushing the hook profiles away from one another in a direction opposite to the load direction. Opening the buckle is thus also possible under load, since the opening movement and the movement required for decreasing the load on the buckle take place in the same direction in the case of this opening possibility and not, as in the prior art, perpendicular to one another.

Preferably, the width direction of the buckle is a first direction of the closed buckle, which is perpendicular to the load direction. The thickness direction is preferably a second direction of the closed buckle, which is perpendicular to the width direction and the load direction. The hook profiles extend in the width direction longitudinally to one another and exhibit, when seen in a profile view, i.e. in the thickness plane, a hook shape. The longitudinal direction of the buckle corresponds to the load direction.

According to a possible embodiment of the present invention, the hook profiles extend across the entire width of the buckle. This allows alternative opening and closing of the buckle by laterally pushing the hook profiles into one another in the width direction. To this end, the hook profiles are preferably provided with lateral chamfers via which the hook profiles can more easily be pushed into one another from the side.

Alternatively or additionally, the width of the hook profiles may be larger than the maximum thickness of the entire buckle formed by the two coupled buckle components. The respective width of the hook profiles allows a high load transmission via the buckle in spite of the small thickness. Preferably, the width of the hook profiles is here larger than the maximum thickness of the buckle. Preferably, the width of the hook profiles is more than 1.3 times as large as the maximum thickness of the buckle, further preferred more than twice as large.

Further alternatively or additionally, the width of the hook profiles may be more than 0.5 times as large as the length of the buckle in the load direction. Also in this case, the width of the hook profiles allows a high load bearing capacity of the buckle, the design in the form of hook profiles allowing a very short overall size. Preferably, the width of the hook profiles is larger than the length of the buckle in the load direction.

According to a possible embodiment of the present invention, the connection area may be at least one bar around which a textile strap can be wrapped. In particular, the textile strap may be wrapped around the bar in the form of a loop, the textile strap being preferably sewn up so as to form the loop.

Alternatively, the connection area may be at least one plate. This plate may especially be used for riveting to one of the elements to be coupled. To this end, the plate has preferably at least one and preferably a plurality of openings, which allow the rivets to pass therethrough.

Preferably, the bar and/or the plate, which define the connection area, extend/extends perpendicular to the load direction of the buckle. This guarantees a particularly good force transmission. Alternatively or additionally, the bar and/or the plate may extend in the width direction of the buckle. In particular, the bars and/or plates of the buckle components may, at the coupled position, extend parallel to another and/or parallel to the direction of extension of the hook profiles. Thus, a buckle having a short and comparatively thin overall size is provided. If a plate is used, it extends preferably in the width direction and in the length direction of the buckle.

Preferably, the coupling areas of the buckle according to the present invention each comprise a hook arm and a hook tip, when seen in a profile view, the hook tip defining the free end of the hook and being connected, when seen in a profile view, to the hook arm via a bend or a chamfer and, via said hook arm, to the connection area of the buckle component.

Preferably, the hook tip defines a respective locking edge extending in the width direction, and the hook arm and the hook tip define an insertion groove extending in the width direction.

Preferably, the locking edges of the two buckle components rest on the insertion grooves of the respective other buckle component at the coupled position of the buckle. This guarantees excellent force transmission and a high load bearing capacity. Preferably, the opening side of the insertion groove is oriented in a direction opposite to the load direction, i.e. the locking edges are inserted into the insertion groove by moving them in the load direction.

According to a possible embodiment of the present invention, the width of the locking edge is larger than the length of the locking edge, i.e. the dimensions of the locking edge in the width direction are larger than those in the length direction. Preferably, these dimensions are twice as large and in particular more than four times as large. Alternatively or additionally, the width of the insertion groove may be larger than the depth of the insertion groove. In particular, the width may here be twice as large and, in particular, more than four times as large as the depth. Also this results in a buckle which is stable due to its dimensions in the width direction, but which has a very short overall size in view of its small depth and length.

In addition, for the purpose of load transmission, the coupling areas may, at the coupled position, rest on one another via a respective hook-tip inner surface facing the hook arm. This allows a transmission of high forces. In addition, a respective hook-tip outer surface of one of the coupling areas, which faces away from the hook arm, preferably rests on an inner surface of the hook arm of the other coupling area. Hence, one of the coupling areas is supported by the other coupling area also in a direction opposite to the load direction.

Preferably, the inner surfaces of the hook tip, which rest on one another, are oriented obliquely to the load direction of the buckle at the coupled position. Preferably, the thus defined hooking angle is an angle between 45° and 85°, further preferred between 50° and 70°, to the load direction.

According to a specially preferred embodiment of the present invention, the hook tip, when seen in a profile view, is wedge-shaped. Alternatively or additionally, the inner side of the hook tip defines together with the inner side of the hook arm a wedge-shaped insertion groove. Due to the wedge shape, the hook profiles can be inserted into one another in the load direction in a particularly easy manner. Preferably, the wedge angle of the hook tip and/or of the insertion groove is an angle between 1° and 30°, further preferred between 5° and 20°.

Preferably, the locking element automatically locks the buckle components to one another during closing. In particular, locking takes place automatically when the hook profiles are pushed into one another. For this purpose, the locking element may be configured as an elastic element and may first undergo deformation during insertion of the two hook profiles into one another, and then snap back into a locking position at the coupled position.

Preferably, the locking can be released without causing a release of the load transmission via the coupling of the buckle components. In particular, the locking can be released independently of the opening movement of the buckle, through which the two buckle components are moved away from their coupled position. Thus, the locking can be released first, and the coupling of the buckle components and, consequently, the load transmission only later on.

According to a preferred embodiment of the present invention, the locking element has an elastic locking arm which locks with at least one locking edge serving as a counterelement. The locking arm may, at the locked position, engage an opening whose wall or walls serves/serve as a locking edge.

Alternatively or additionally, the locking arm may lock with a counteredge when the buckle has applied thereto a load in a direction opposite to the load direction as well as when it has applied thereto a lateral load in the width direction. The respective counteredges may here be defined by the walls of a suitable opening.

Further alternatively or additionally, the locking arm may become wedged with a locking edge, when the buckle has applied thereto a load in a direction opposite to the load direction. For this purpose, the locking edge or the locking arm may be provided with a chamfer. Preferably, the chamfer defines an angle between 65° and 100°, further preferred between 75° and 90°, relative to the centerline of the hook tip.

Further alternatively or additionally, the locking-arm part, which locks when the buckle has applied thereto a load in a direction opposite to the load direction, may be defined by wings which are arranged laterally on the locking arm. These wings preferably engage a groove-shaped recess, so that a wall area of the groove-shaped recess serves as a locking edge. In particular, grooves with which the wings enter into locking engagement may be arranged laterally in the walls of a larger recess which the locking arm engages.

Further alternatively or additionally, the load on the locking engagement between the locking arm and the locking edge can be decreased, when the buckle has applied thereto a load in the load direction, whereby the locking arm can more easily be moved away from the locking position. Also this has the effect that it will be possible to easily open the buckle under load.

Furthermore, the locking element, and in particular the locking arm, may be arranged on one of the two buckle components according to the present invention and lock with a counterelement arranged on the other buckle component, said counterelement being especially a locking edge arranged on the other buckle component. In particular, the counterelement may be an edge of an opening arranged in the other buckle component.

Preferably, the locking element is arranged in the area of the outer surface of the hook tip of one of the buckle elements. In particular, the locking arm may be connected to the hook tip in the area of the free end of the latter and may, as for the rest, be separated from the outer surface through openings. Preferably, the locking arm projects, when seen in a profile view, beyond the outer surface. Thus, the locking arm, when occupying the locked position, preferably engages an opening provided in the other buckle element, and locks with the walls of this opening. Preferably, the locking arm has an S-shape, which merges, starting from a base area that is flush with the outer surface of the hook tip, with a head area projecting beyond the outer surface.

Alternatively or additionally, the counterelement may be arranged in the area of the inner side of the hook arm of the other buckle element. Preferably, the counterelement is defined by an opening in the inner surface of the hook arm. In particular, the opening may extend through the material of the hook arm and/or be open towards the connection area.

Additionally, the locking engagement may, according to the present invention, be releasable by pulling an operating element. The operating element provided is, in particular, a string loop.

Preferably, the operating element and in particular the string loop are deflected. The locking engagement can thus reliably be released, independently of the direction from which a pulling force is applied to the operating element. In particular, the deflection may be effected via a through-hole through which the operating element is passed. Preferably, the operating element may, between the connection with the locking element and a handling area at which the operating element is taken hold of for release, be passed through a through-hole arranged in the buckle component. In particular, the through-hole may be arranged in an outer side of the hook arm. Preferably, this outer side of the hook arm is arranged in spaced-apart opposed relationship with the locking element and in particular the locking arm.

Alternatively or additionally, a surface of the buckle component spaced-apart from the locking element may serve as a stop for the locking element. Preferably, the stop is defined by a wall of an opening extending through the bend or the chamfer of the hook profile. The stop prevents damage being caused to the locking element and in particular the locking arm when an excessively strong pulling force acts on the operating element.

Further alternatively or additionally, the locking element configured as a locking arm may comprise a through-hole via which the operating element is connectable to the locking arm. Further alternatively or additionally, a surface of the buckle component spaced-apart from the locking arm, and in particular the stop may also comprise a through-hole through which the operating element is passed, thus defining a deflection.

Further alternatively or additionally, a handle element may be provided in the handling area of the operating element. The operating element according to the present invention may in particular be a string loop, the string being passed through respective through-holes of the buckle component. Further preferred, the string of the string loop is connected to the handle element and may e.g. be passed through a through-hole in the handle element. The string loop may additionally be combined by means of a shrink-on hose so as to form a string.

Preferably, the buckle components according to the present invention are adapted to be coupled to one another by means of the coupling areas, configured as hook profiles, through a movement in the load direction, i.e. through a movement comprising a movement component in the load direction. Such a movement in the load direction has the advantage that the buckle components can easily be coupled to one another. In addition, a high stability of the connection is guaranteed, since the hooks interengage due to the movement in the load direction and are thus able to take up high forces in the load direction at the coupled position.

Preferably, the coupling areas hook into one another, during coupling, at an acute angle to the load direction. This can be accomplished especially by configuring the hook profiles with an acute hook angle according to the present invention.

According to a preferred, but not necessary embodiment of the present invention, the buckle components may also be coupled to one another by pushing the hook-shaped coupling areas into one another in the width direction. This kind of lateral insertability represents, according to this preferred embodiment, a further possibility of closing the buckle and may, in addition, serve to clean the insertion grooves.

Furthermore, the buckle components may, in accordance with the present invention, be adapted to be released from one another by a movement in a direction opposite to the load direction, i.e. by a movement comprising a component in a direction opposite to the load direction. The movement is here preferably a movement in a direction opposite to the coupling movement. Also this has the effect that the buckle can be released more easily. Preferably, the coupling areas, during decoupling, disengage from one another at an obtuse angle in a direction opposite to the load direction, this being, in turn, made possible by suitably configuring the hook profiles with an acute hook angle.

Also in this case, the buckle components may, according to a preferred embodiment, which is, however, not necessarily realized, be released from one another by pushing the hook-shaped coupling areas away from one another in the width direction.

According to a possible embodiment of the present invention, the locking element and the counterelement associated with the locking element are, when seen in the width direction, arranged centrally on the buckle. In particular when the locking element and the counterelement are arranged in the area of the hook tip and/or of the hook arm, the load bearing capacity of the hook profile is weakened in this area. Due to the central arrangement it is ensured that on both sides of the locking element and of the counterelement sufficient hook profile will be available for guaranteeing a stable load transmission. In addition, a uniform distribution of forces is thus guaranteed in the width direction.

Alternatively or additionally, the buckle components may be configured symmetrically with respect to a center plane in the width direction. Also this allows a uniform, symmetric distribution of forces.

Further alternatively or additionally, the hook arm and the hook tip may have openings in the width area of the locking element and of the counterelement, respectively. Material can thus be saved in an area that does not have a prominent function for load transmission anyhow.

In addition, the hook arm of the hook profiles may be provided with reinforcing ribs on its back. This guarantees a transmission of forces in combination with low material requirements. Furthermore, the hook arm can be manufactured more easily, since smaller wall thicknesses have to be dealt with.

Further alternatively or additionally, the buckle-component bars defining the connection areas may be connected on both sides thereof to an extension of the respective hook arm, an opening, through which a textile strap can be passed, being provided between the rear edge of the hook arm and the bar.

Further alternatively or additionally, the plates defining the connection areas may each define an extension of the respective hook arm. An opening between the rear edge and the plate is not necessary in this case, but the plate may directly adjoin the rear edge of the hook arm.

According to a specially preferred embodiment of the present invention, the buckle components are each configured as an integral component. In particular, the connection areas and the coupling areas are configured as integral components. Further preferred, the locking element and the counterelement, respectively, are formed integrally with the respective buckle component.

The buckle components may preferably be injection-molded parts. Alternatively or additionally, the buckle components may be made of plastic.

Specially preferred, the buckle according to the present invention may have a static load bearing capacity of more than 50 kg. Further preferred, the static load bearing capacity may be higher than 100 kg, further preferred higher than 150 kg. The buckle construction according to the present invention allows a very high load bearing capacity on the basis of very small overall dimensions and, in particular, on the basis of a very small length.

Preferably, the buckle according to the present invention has a width of more than 2.5 cm and further preferred of more than 4 cm. If comparatively high forces are to be transmitted, the width may also be increased accordingly. Preferably, the buckle has a length of less than 5 cm, and in particular of less than 4 cm. The buckle according to the present invention is particularly compact especially in the longitudinal direction. Further preferred, the buckle has a thickness of less than 3 cm and further preferred of less than 2.5 cm. On the basis of these dimensions, the buckle according to the present invention accomplishes the above described, very high static load bearing capacities.

In addition to the buckle according to the present invention, the present invention also comprises an object that can be worn on the human body and that is provided with a buckle of the type described hereinbefore. The object that can be worn on the human body may in particular be a ballistic vest. Alternatively, it may, however, also be a rucksack or a piece of equipment.

Preferably, the object comprises at least two elements, each of said elements being connected to a respective connection area of one of the buckle components. The two elements of the object can thus be releasably interconnected via the buckle according to the present invention. The connection to the buckle can be established in particular by means of textile straps.

Preferably, the object is adapted to be fastened or secured to the human body by closing the buckle and to be released from the human body by opening the buckle.

In particular, the object according to the present invention may be a ballistic vest comprising a front part and a rear part, which are interconnected in the shoulder area and/or on the side or sides. The connection of the front part and the rear part is preferably established by at least one buckle according to the present invention.

Preferably, the connection is established, on at least one side, by at least one respective buckle according to the present invention in the shoulder area as well as on the side. Preferably, the connection is established, on both sides, by at least one respective buckle according to the present invention in the shoulder area as well as on the sides.

Preferably, textile straps are connected to the rear part and the front part, thus allowing the connection to be established via the buckle according to the present invention. According to a preferred embodiment of the present invention, the textile straps may be adapted to have arranged thereon additional equipment. The small length of the buckle according to the present invention allows an arrangement of a plurality of pieces of equipment. The textile straps may e.g. be sewn to the front and/or the rear part and may preferably be releasably secured to the respective other part, e.g. passed through a tunnel and/or fastening element.

In particular, also an abdominal belt may be provided, which has buckle components on both sides thereof and which is passed through a tunnel from one side to the other side. The abdominal belt may include an elastic area, preferably within the tunnel. Furthermore, shoulder belts may be provided, which, for the purpose of length adjustment, are passed through a fastening element and which define an adjustable loop via a hook and loop fastener.

Alternatively, it is imaginable to rivet one or both buckle components directly to the front part or the rear part.

Other aspects and advantages of the present invention will be apparent from the following detailed description of the preferred embodiments and the accompanying drawing figures.

BRIEF DESCRIPTION OF THE SEVERAL VIEWS OF THE DRAWINGS

The present invention is now described in more detail making reference to an embodiment as well as to the drawings, in which.

Figure 1:
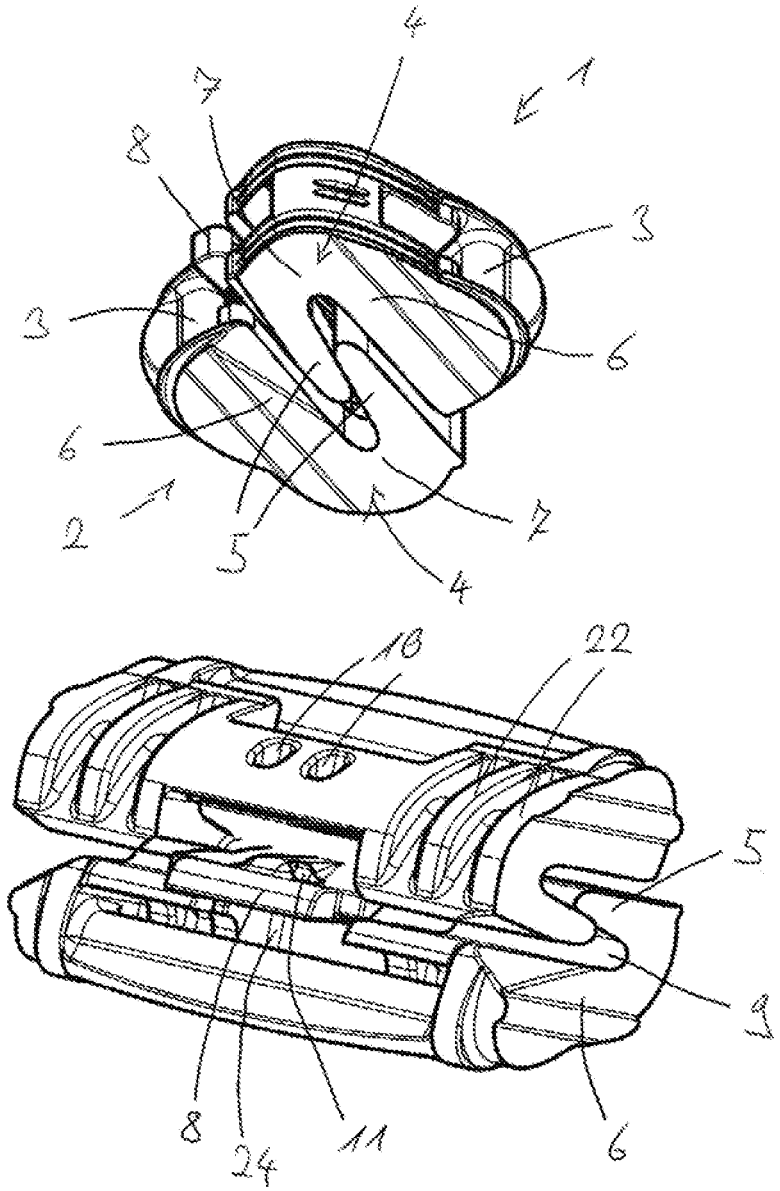
FIG. 1 shows two perspective views of an embodiment of the buckle according to the present invention during a coupling movement in the load direction.

While the disclosure is susceptible to various modifications and alternative forms, a specific embodiment thereof is shown by way of example in the drawing and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

The figures show an embodiment of a buckle according to the present invention. The buckle according to the present invention can be used for the load coupling of components, in particular for the load coupling of objects that can be worn on the human body. To this end, the buckle according to the present invention is bipartite and comprises a first buckle component 1 and a second buckle component 2.

Each of the two buckle components has a connection area 3 for connection to a textile strap. In the present embodiment, bars 3, about which the textile strap can be wrapped, are provided for this purpose. The bars 3 in the present embodiment extend in the width direction of the buckle and perpendicular to the load direction of the buckle. Alternatively, the connection areas used may also be plates, via which the buckle components are riveted to a textile strap or directly to an element to be coupled. Also other embodiments of the connection area are imaginable. The connection areas of the two buckle components may be configured identically or differently.

Coupling between the two buckle components is effected through interengaging hook geometries. Each of the two buckle components has a hook profile extending in the width direction, said hook profiles engaging each other at the coupled position of the buckle components, thus coupling the two buckle components to one another.

In the present embodiment, the hook profiles 4 each have a hook tip 5 connected to the hook arm 6 via a bend or a chamfer 7. The hook arm 6, in turn, is connected to a connection area 3. The interengaging hook tips thus provide load coupling, the load being transferred from the hook tips 5 via the hook arms 6 to the connection areas 3.

Due to the fact that the hook profiles 4 extend in the width direction, i.e. parallel to the direction of the bars defining the connection areas 3, the hook tips 5 each define a respective locking edge, and the hook tips 5 together with the hook arms 6 define insertion grooves, with which the locking edge of the respective other buckle component enters into engagement.

During coupling of the buckle, the two buckle components are locked automatically, whereby the two buckle components will be prevented from being inadvertently released from one another. To this end, the first buckle component 1 includes a locking element 8, which engages an opening 24 of the second buckle component 2 for the purpose of locking. In the present embodiment, the locking element is configured as a spring-loaded detent.

Figure 2:
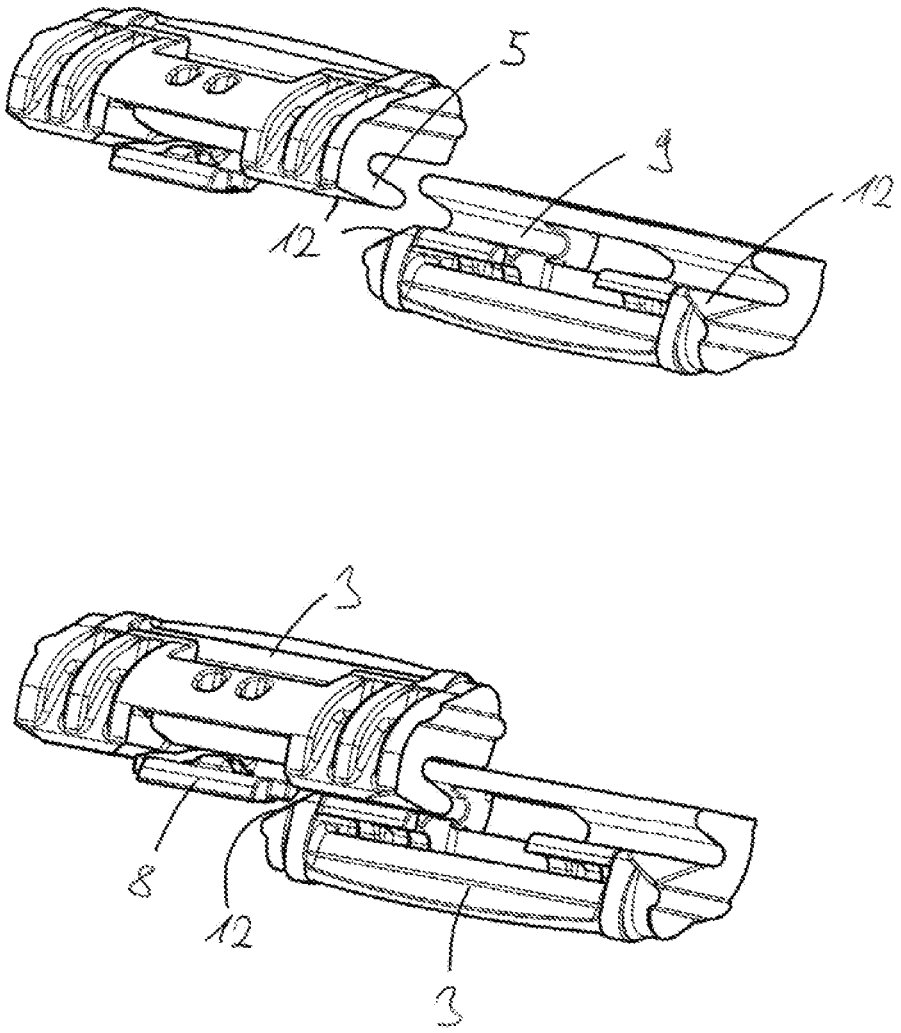
FIG. 2 shows two perspective views of the embodiment of the buckle according to the present invention during coupling in the width direction.

In the embodiment shown in the figures, coupling of the buckle can take place in two directions, which are shown in FIGS. 1 and 2. As a first possibility, the two buckle components may be coupled in the load direction of the hook geometry. To this end, one of the hook profiles is inserted into the other hook profile with a movement corresponding to the hook angle of the hook profile and comprising thus a component in the load direction. FIG. 1 shows here a condition of the two buckle components just before the hook profiles are completely inserted into and coupled with one another.

A second possibility of coupling is shown in FIG. 2. The two hook profiles can laterally be inserted into one another. To this end, the locking edges 5 of the hook profiles are laterally inserted into the insertion grooves 9 of the hook profiles, whereupon the two buckle components are pushed into one another in the width direction. In order to allow simpler lateral insertion, the two buckle components have lateral chamfers 12. The chamfer on the second buckle component additionally ensures that the locking element of the first buckle component is pushed into the surface of the profile during the insertion process.

In order to guarantee the lateral insertability of the hook profiles as well as the coupleability in the load direction, the hook profile has a uniform structural design in the width direction, i.e. the hook profile has a uniform profile in a plane perpendicular to the width direction, with the exception of the central interruption through the locking elements. In addition, also the outer and inner surfaces of the hook tip as well as the inner surface of the hook arm are smooth in the profile direction. This guarantees easy insertion in the width direction as well as in the load direction.

However, this kind of structural design of the profiles is not absolutely necessary for realizing the present invention. According to an alternative embodiment of the present invention, which is not shown, the lateral insertability of the hook profiles may e.g. be dispensed with. In this case, the hook profiles may have profile shapes varying in the width direction, or they may be laterally closed. By way of example, also a surface of the coupling areas that is knurled in the width direction is here imaginable. In a plane perpendicular to the width direction, the surfaces of the coupling areas lying on top of one another are preferably configured as smooth surfaces so as to allow easy insertion into one another, but this is not absolutely necessary either. Also in this case, knurls or flutes may be provided, e.g. for the purpose of intensifying the self-coupling effect.

Figure 3:
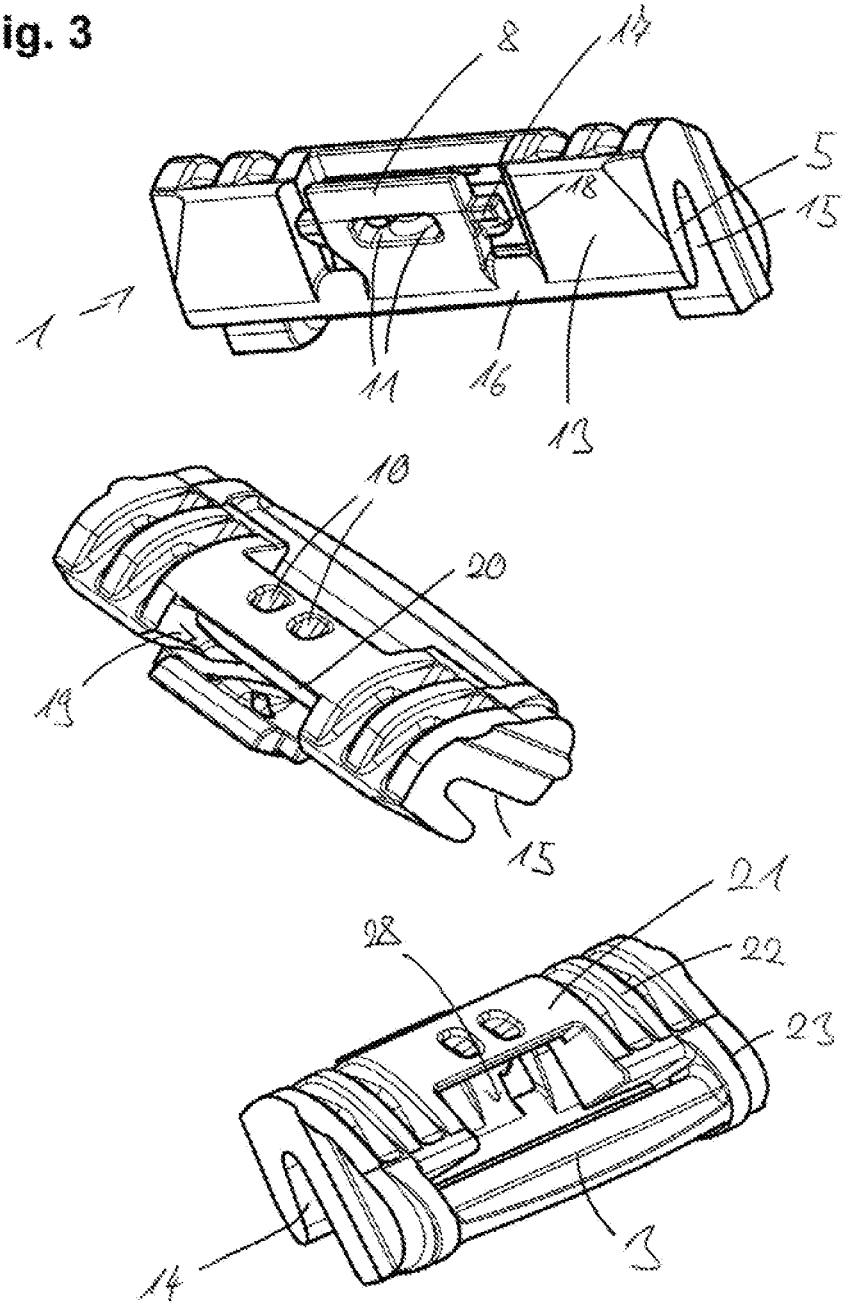
FIG. 3 shows three perspective views of the first buckle component of the buckle according to the present invention with the locking element.
Figure 4:
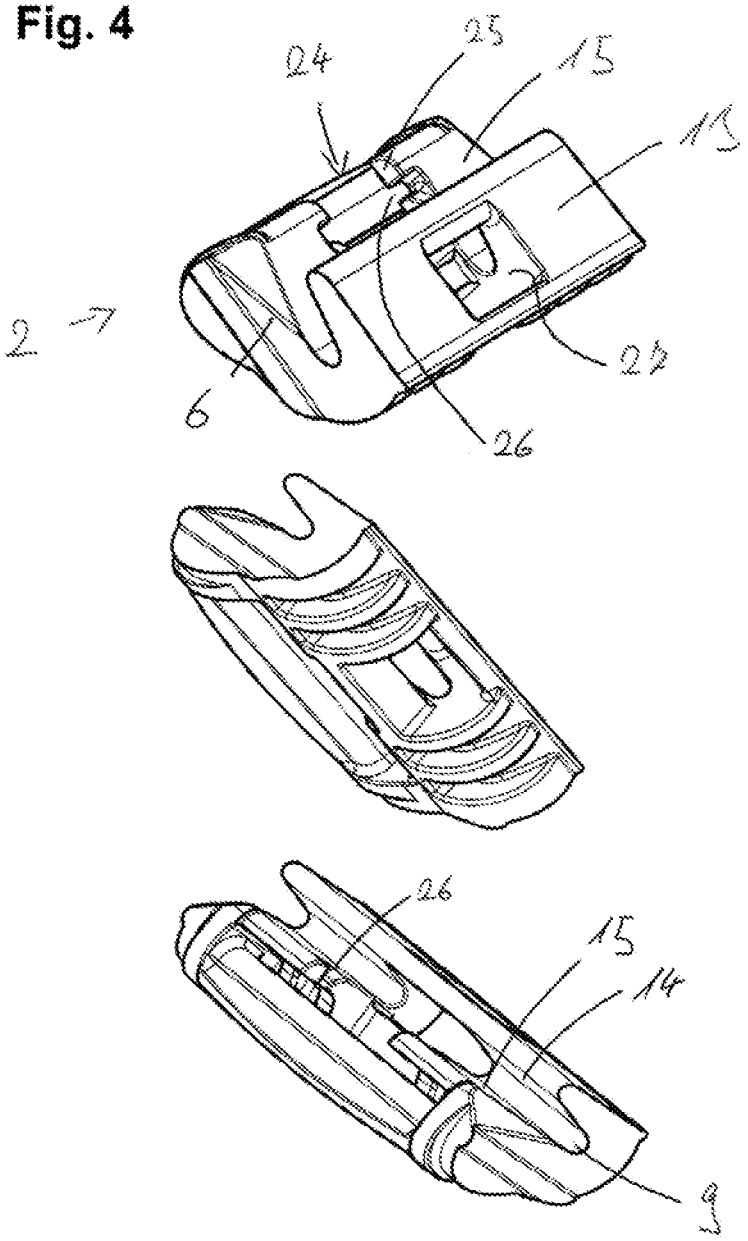
FIG. 4 shows three perspective views of the second buckle component of the buckle according to the present invention with an opening defining the counterelement.

The structural design of the locking element 8 and of the opening 24 defining the counterelement can be seen in more detail in FIGS. 3 and 4. The locking element 8 and the counterelement 24 are each integrated in the respective buckle component. In the present embodiment, the locking element 8 and the opening 24 are provided in the respective coupling areas of the buckle components, and, consequently, they will automatically enter into locking engagement during the coupling process. Unlocking of the locking element is possible independently of a disengagement of the two buckle components.

In the present embodiment, the locking element and the counterelement are arranged centrally in the respective coupling area with respect to the width direction of the buckle, so that parts of the hook profiles, which serve the purpose of load transmission, remain on both sides.

As can be seen in more detail from FIG. 3, the locking element 8 is configured as a locking arm arranged in the outer surface 13 of the hook tip 5. The locking arm 8 has its base area connected to the front edge 16 of the hook tip 5 and extends along the outer surface 13 of the hook tip 5. With the exception of its base area, the locking arm 8 is separated from the hook tip by openings in the material. The free upper edge of the hook arm ends in the area of the upper edge of the bend 7 through which the hook tip 5 is connected to the hook arm 6.

The opening 24 acting as a counterelement to the locking arm 8 is consequently arranged in the inner surface 15 of the hook arm 6 of the second buckle component 2. In the present embodiment, the opening 24 extends fully through the material of the hook arm 6.

Locking between the locking arm 8 and the opening 24 is effected in that the locking arm 8 projects beyond the outer surface 13 of the hook tip 5. During coupling of the two buckle elements, the locking arm 8 is first deformed and, at the coupled position, it then snaps into the opening 24. In the present embodiment, the locking arm 8 has an S-shape.

Locking between the locking arm 8 and the opening 24 is effected in a lateral direction through the sidewalls of the locking arm 8 and the sidewalls 25 of the opening 24, which enter into locking engagement with one another. For the purpose of locking against a movement opposite to the load direction, the locking arm 8 has, however, provided thereon lateral wings 17, which engage grooves 26 provided in the sidewalls 25 of the opening 24. The wings are provided with chamfers through which the locking arm is deflected during coupling in the load direction before the wings enter into locking engagement with the grooves 26 at the coupled position.

Due to this locking by means of lateral wings, the opening 24 can be open in a rearward direction, whereby manufacturing will be simplified. According to an alternative embodiment, which is not shown, the opening 24 may, however, also be configured as a closed opening, so that a rear wall of the opening and an upper edge of the locking arm would lockingly engage each other.

For the purpose of opening the buckle, the locking engagement must first be released. This is done by lifting the locking arm 8 out of the opening 24. The lifting of the locking arm 8 out of the opening 24 has initially no effect on the load coupling of the two buckle components through the hook profiles, but it allows the hook profiles to be pushed away from each other, so that the coupling can be released by a separate movement.

For lifting the locking arm out of the recess, the first buckle component 1 including the locking arm 8 is provided with a through-hole 10 for the operating element used for the purpose of lifting, said operating element being not shown in the drawings. This operating element is preferably a string loop, which is connected to the locking element via the openings 11 and which is deflected through the through-hole 10. This makes the direction of the unlocking movement independent of the direction of movement of the locking element that serves as a detent.

In the present embodiment, the through-holes 10 are arranged in a hook arm back 21 located opposite the locking arm 8. The buckle component has an opening 20 extending through the bend 7, the back 21 of the hook arm being opposed to the locking arm 8 via the opening 20. The inner side of this opening defines a stop for the hook arm, so that the latter can no longer be damaged through pulling of the operating element, since the maximum deflection will be limited by the stop. Also the through-hole 10 for the operating element is provided in the area of the stop.

The buckle geometry according to the present invention allows the buckle to be released also under load. Due to the orientation of the locking surfaces, which define the detent, relative to the load direction, the force required for unlocking the locking element is even reduced when the buckle is under load, since, in a condition under load, the upper edge of the wings 17 serving as a detent is moved away from the inner edge of the groove 26, whereby unlocking will be facilitated.

If it is attempted to forcibly release the buckle parts against the locking, clamping of the locking element 8 in the opening 24 and of the wings 17 in the groove 26 will, at the coupled condition, prevent the buckle from being opened. Forcible unlocking is thus prevented.

Release of the coupling may, in turn, take place in two different directions, i.e. by decoupling the hook profiles in a direction opposite to the load direction or by pushing apart the hook profiles to the side. Also in this case, embodiments are imaginable in the case of which decoupling takes place exclusively in a direction opposite to the load direction of the hook geometry.

The possibility of pushing the hook geometry laterally in and out according to the present invention has, however, the additional advantage that the hook geometries can be cleaned in this way, since dirt remaining in the hook profiles will be pushed out of the hook profile to the side.

The bars 3 serving as connection areas are connected on both sides thereof with lateral extensions 23 of the hook arms 6. Between the rear edge of the hook arms and the bars 3, a through-hole is provided for passing a textile strap, e.g. a belt, therethrough. The shape of the bars 3 and of the through-hole 29, which has been chosen for the present embodiment, can be seen in particular from the sectional views in FIG. 6. The bars 3 are here rod-shaped. When seen in a profile view, the bars are provided with an edge on the inner side thereof, the strap being wrapped around said edge. The outer side of the bars is provided with a reinforcing rib.

The hook profiles have additional openings 27 and 28, respectively, in their central area, where the locking arm and the opening used as a counterelement are arranged. In particular, the hook arm of the first buckle component has, in an area arranged on the level of the locking arm 8 when seen in the width direction, an opening 28 so as to save material and avoid unnecessarily thick areas. Also the buckle component 2 has an opening 27 in the hook tip area located opposite the opening 24, when seen in the width direction. As regards the hook tip, only a front and a rear edge remain here, said front and rear edges delimiting the opening 27. The openings can be arranged here, since the central area of the buckle serves more the purpose of locking than the purpose of force transmission.

In the two areas constituting the outer areas in the width direction, a continuous hook profile is provided, since load transmission takes place here. In the present embodiment, the hook tip is configured as a solid component in this area. The back of the hook arm is provided with reinforcing ribs according to the present embodiment, so as to achieve a high load bearing capacity without making use of unnecessarily large wall thicknesses. In these lateral areas, the hook arm is separated from the connection element only by a narrow channel through which the textile strap is passed.

The angular relationships of the buckle according to the present invention will now be described in more detail making reference to the sectional views shown in FIGS. 6 and 7 in planes perpendicular to the width direction. The position of the respective sectional planes can here be seen in the top view shown in FIG. 5.

Figure 6:
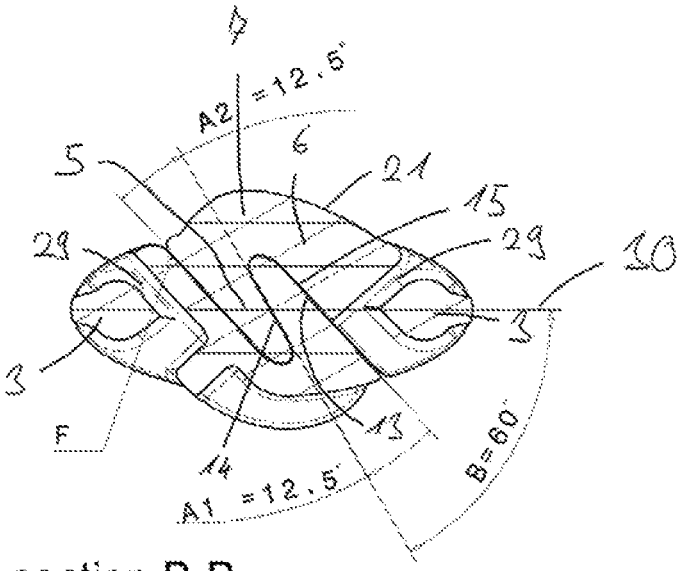
FIG. 6 shows sections through the planes B-B and D-D in FIG. 5.
Figure 6:
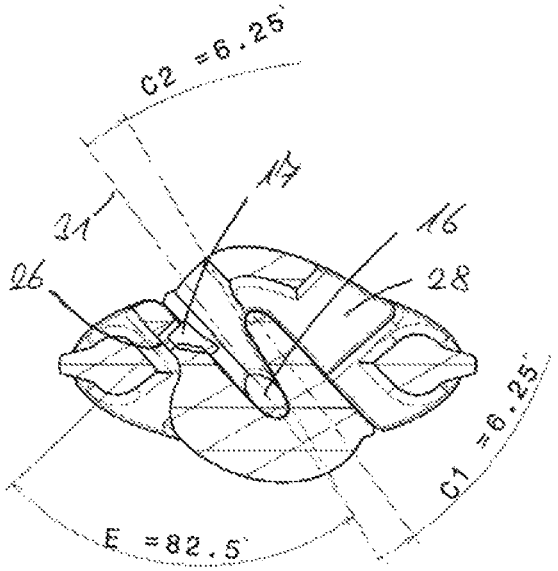

FIG. 6 shows, in its upper view, a section along plane B-B, i.e. in a load-transmitting area of the buckle. It follows that, in the present embodiment, this is an area that is arranged laterally to the central area used for the purpose of locking.

As can be seen from FIG. 6, each of the hook tips 5 is wedge-shaped. The wedge angles A1 and A2 of the hook tips are used for centering and for allowing the hook profiles to be more easily inserted into one another. The inner surface 14 of the hook tip 5 defines together with the inner side 15 of the hook arm 6 a wedge-shaped intake guide, which is configured complementarily to the wedge-shaped hook tip. Due to the extension in the width direction, the hook tip 5 thus defines a wedge-shaped locking edge, and the inner sides 14 and 15 of the hook tip and of the hook arm define a wedge-shaped intake groove.

In the present embodiment, the wedge angles A1 and A2 of the hook tips of the first and of the second buckle component are identical. In alternative embodiments, the wedge angles may, however, also be chosen such that they are different. The wedge angle is preferably an angle between 1° and 30°, further preferred between 5° and 20°, further preferred between 10° and 15°. In the present embodiment, the wedge angle is an angle of 12.5°.

The load direction is shown in FIG. 6 as a line 30 and runs through the respective centers of the connection areas 3 in the coupled condition of the buckle. The width direction extends perpendicular to the load direction along the direction of extension of the connection areas 3 and, consequently, perpendicular to the plane of the sheet in FIG. 6.

The inner sides 14 of the hook tips lie on top of one another at the coupled position and form the main load-transmitting area of the buckle. The inner sides are inclined relative to the load direction 30 at a hooking angle B, said hooking angle B lying preferably in a range between 40° and 85°, further preferred between 45° and 80°, further preferred between 50° and 70°. In the present embodiment, the hooking angle is an angle of 60°.

Figure 5:
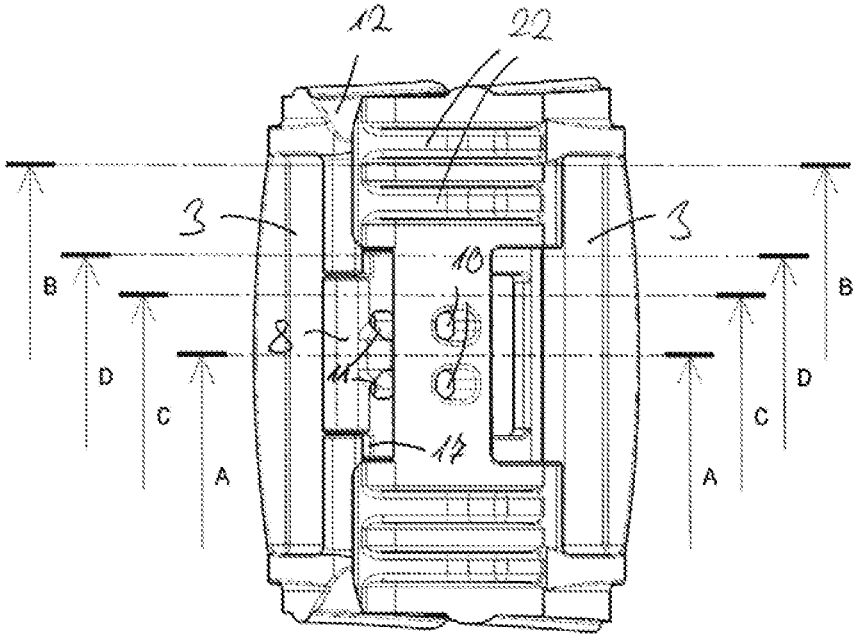
FIG. 5 shows a top view of the buckle according to the present invention at the coupled position.

FIG. 6 shows, below, a section along planes D-D in FIG. 5, i.e. a section through the locking area on the level of the wings 17. As can clearly be seen in this sectional view, the wings 17 are arranged in the grooves 26 at the coupled position, an upper edge of the wings 17 coming to lie against an upper inner edge of the groove, when the buckle has a load applied thereto in a direction opposite to the load direction. The retaining angle E of the detent against inadvertent release in the load direction of the buckle lies in a range between 65° and 100° to the centerline of the hook tip of the first buckle component. In the present embodiment, this angle is an angle of 82.5°. The centerlines of the wedge-shaped hook tips define approximately the direction in which the coupling areas try to disengage when they have applied thereto a load in a direction opposite to the load direction:

The centerlines of the two hook tips may extend parallel to one another, as in the case of the present embodiment. Alternatively, they may, however, also be not in parallel. The angle which the centerlines define relative to the load direction 30 is preferably an angle between the 30° and 80°, preferably between 40° and 65°. In the present embodiment, it is an angle of 53.75°.

The centerline angle C1 and C2, respectively, to the hooking angle B is preferably an angle between 0° and 30°, further preferred between 2° and 15°. In the present embodiment, it is an angle of 6.25°.

Figure 7:
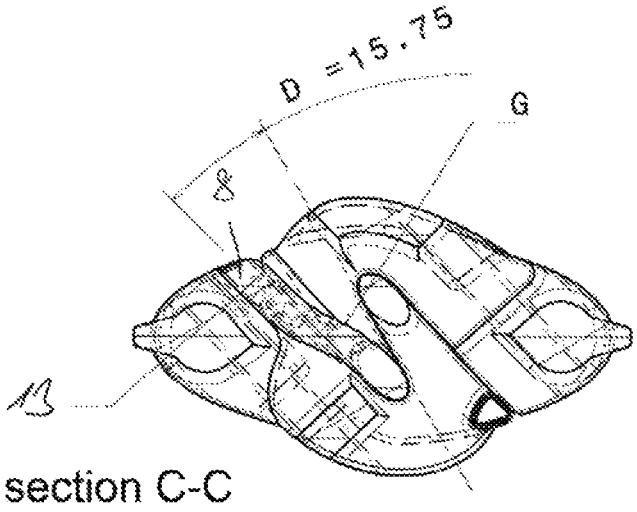
FIG. 7 shows sections through the buckle according to the present invention in planes C-C and A-A in FIG. 5.
Figure 7:
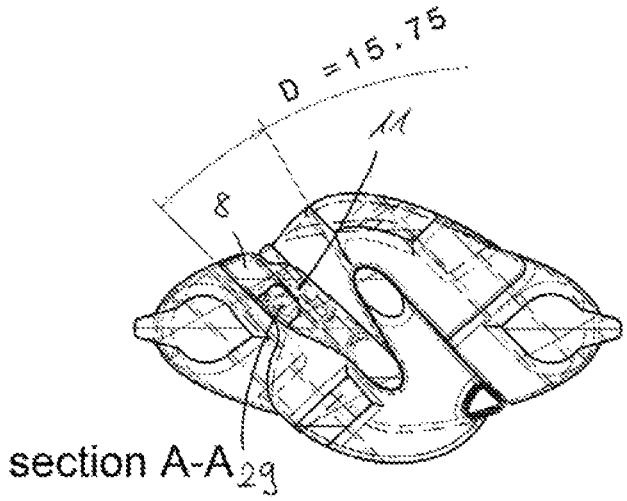

FIG. 7 shows additional sectional views along planes C-C and A-A, i.e. through the central area of the locking arm 8. As can be seen from section C-C, the spring effect of the spring arm results from a torsional spring obtained through the connection via the bar-shaped front edge 16 of the hook tip to the remaining part of the hook tip, as well as from a flexible spring in the area of the locking arm itself. The locking arm extends in an S-shape through the contact surface 13 with which the outer side of the hook tip rests on the inner side of the hook arm of the second buckle component. The upper edge of the locking arm is here flush with the upper edge of the opening in the second buckle component.

As can be seen in section A-A, the locking arm has, in the area of the through-hole 11 for the operating element, a bulge through which the through-hole 11 extends as well as a recess 29, which is disposed therebelow and which has the deflection of the string loop arranged therein. This deflection area of the string loop is thus arranged on a lower level and is therefore protected.

The buckle according to the present invention serves quite generally the purpose of load coupling of components by connecting two textile straps. According to a specially preferred embodiment, the present invention is used for the load coupling of objects that can be worn on the human body. In particular, the buckle may be used for holding the object on or securing it to the human body, so that the object can be removed from the human body by releasing the buckle.

Figure 8:
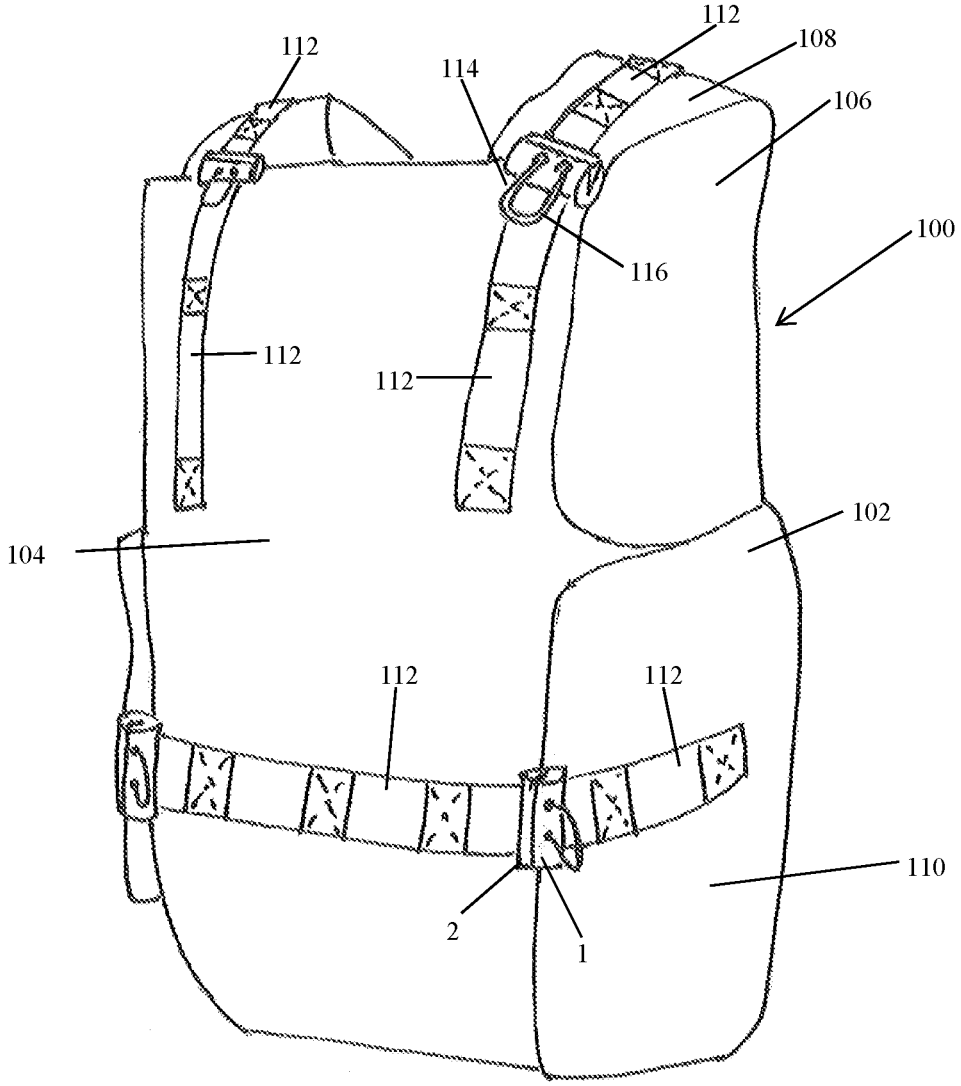
FIG. 8 shows one embodiment of an object using one embodiment of a buckle according to the teachings of the present invention, wherein the object is a vest.

FIG. 8 illustrates an embodiment wherein the object 100 in question is in particular a ballistic vest 102. Such ballistic vests 102 normally have a front part 104 and a rear part 106, which are interconnected in the shoulder area 108 and on the side or sides 110. The front part 104 and the rear part 106 normally have provided therein protective elements knot shown) as a protection against bullets. These protective elements may be configured e.g. as plates, which are inserted into the front part 104 and the rear part 106. Such a protective vest 102 must be easy to release from the human body. To this end, preferably the rear part 106 and the front part 104 each have textile straps 112 on the side or sides 110 and in the shoulder area 108, said textile straps 112 being connected to the connection areas of the buckle components 1 and 2 as shown. The buckles thus serve to close the protective vest 102 in the shoulder area 108 and on the side 110, preferably on both sides. As further shown in FIG. 8, the locking engagement may, according to the present invention, be releasable by activating an operating element 114. The operating element 114 provided may be a string loop 116 in one embodiment.

The textile straps are preferably passed through the connection area and are then sewn up such that a loop is formed or they are connected by means of a hook and loop fastener so as to form a loop. Additional equipment can be attached to the textile strap. Due to the short overall length of the buckle according to the present invention, a very great length is here available for attaching equipment thereto.

Due to the simple possibility of unlocking the buckle by pulling the operating element, the buckle is easy to open for removing the protective vest from the human body. Preferably, buckles are provided on both sides.

The buckles according to the present invention may, however, also be used for other applications, e.g. for rucksacks, belts, bags or other equipment.

The buckle according to the present invention has an extremely high load bearing capacity. In the present embodiment, the buckle has a width of approximately 5 cm, a length of approximately 4 cm and a thickness of approximately 2 cm. However, a buckle having a smaller width of approximately 2.5 cm, with otherwise identical dimensions, would be imaginable as well. The length is here the maximum length of the buckle in the load direction, the width is the maximum width in the width direction, and the thickness is the maximum thickness perpendicular to the load direction and the width direction The carrying capacity of the buckle is higher than 150 kg in the present embodiment. The load bearing capacity of the buckle may, however, easily be increased by extending the dimensions of the buckle in the width direction. For example, two juxtaposed connection areas for connection to textile straps may here be provided in the width direction, said connection areas being arranged, when seen in the width direction, on the right-hand and on the left-hand side of the central area, in which locking takes place. Accordingly, the length of the hook profiles on the right-hand and on the left-hand side of the locking element is increased in a corresponding manner.

The load bearing capacity of the buckle can thus be increased, without changing the thickness or the length of the buckle.

As has been described hereinbefore, a string loop is preferably used as an operating element. This string loop can be connected to a handle element. Preferably, the string loop is combined via a shrink-on hose so as to form a single string between the handle element and the buckle in order to prevent inadvertent hooking-in into the loop.

The buckle and/or the handle element are preferably produced from plastic as injection-molded elements.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

We claim:

1. A buckle for releasable load coupling of two elements comprising:

a first buckle component and a second buckle component configured for releasable engagement at a coupled position;

said first buckle component having a first connection area for connecting said first buckle component to a first element of said two elements, and a first coupling area including a first hook profile extending a width direction;

said second buckle component having a second connection area for connecting said second buckle component to a second element of said two elements, and a second coupling area including a second hook profile extending in said width direction;

a locking element for releasably locking said first buckle component to said second buckle component when said first buckle component and said second buckle component are at said coupled position, wherein said first hook profile and said second hook profile are complementary and interengage at said coupled position to couple said first buckle component to said second buckle component in a form-fit manner; and wherein the locking engagement of said locking element in said coupled position is adapted to be released by pulling an operating element connected to said locking element.

2. The buckle according to claim 1, wherein the hook profiles extend across the entire width of the buckle.

3. The buckle according to claim 1, wherein the width of the first and second hook profiles is larger than the maximum thickness of the buckle.

4. The buckle according to claim 1, wherein at least one of the first or the second connection area is one of at least one bar around which a strap can be wrapped, or at least one plate adapted to be riveted to one of the elements, and wherein the one of the at least one bar or the at least one plate extend perpendicular to a load direction.

5. The buckle according to claim 1, wherein the said first hook profile and said second hook profile each comprise a hook arm and a hook tip, the hook tip defining a free end of the hook profile and being connected to a first end of said hook arm at a bend or a chamfer and wherein a second end of said hook arm is connected to the connection area of the respective first and second buckle component.

6. The buckle according to claim 1, wherein, at the coupled position, said first buckle component and said second buckle component are automatically locked to one another by the locking element.

7. The buckle according to claim 1, wherein the buckle components are adapted to be coupled to one another through a movement in the load direction, wherein, during coupling, the coupling areas hook into one another preferably at an acute angle to the load direction.

8. The buckle according to claim 1, wherein the first and second buckle components are each configured as an unitary component, preferably as an injection-molded part and/or made of plastic.

9. The buckle according to claim 1, wherein the buckle has a static load bearing capacity of more than 50 kg.

10. An object that can be worn on the human body, in particular a ballistic vest, rucksack or a piece of equipment, comprising a buckle according to claim 1.

11. An object that can be worn on the human body according to claim 10, comprising:

two elements, each of said elements being connected to a respective connection area of one of the first and second buckle components, wherein the elements are a textile strap;

wherein, the object is adapted to be fastened or secured to the body by closing the buckle and to be released from the body by opening the buckle, wherein said object is preferably a ballistic vest comprising a front part and a rear part, which are interconnected at one or more shoulder areas and at one or more sides of the object, wherein the connection of the front part to the rear part is established by at least one of said buckles disposed on one or more shoulder area and at least one of said buckles disposed on one or more sides of the object.

12. A buckle for releasable load coupling of two elements comprising:

a first buckle component and a second buckle component configured for releasable engagement at a coupled position;

said first buckle component having a first connection area for connecting said first buckle component to a first element of said two elements, and a first coupling area including a first hook profile extending a width direction;

said second buckle component having a second connection area for connecting said second buckle component to a second element of said two elements, and a second coupling area including a second hook profile extending in said width direction;

a locking element for releasably locking said first buckle component to said second buckle component when said first buckle component and said second buckle component are at said coupled position, wherein said first hook profile and said second hook profile are complementary and interengage at said coupled position to couple said first buckle component to said second buckle component in a form-fit manner;

wherein at least one of the first or the second connection area is one of at least one bar around which a strap can be wrapped, or at least one plate adapted to be riveted to one of the elements, and wherein the one of the at least one bar or the at least one plate extend perpendicular to a load direction; and wherein the hook tip defines a locking edge extending in the width direction, and the hook arm and the hook tip define an insertion groove extending in the width direction, and wherein, at the coupled position of the buckle, the locking edges of one of said first buckle component and said second buckle component rest on the insertion groove of the other one of said first buckle component and said second buckle component.

13. The buckle according to claim 12, wherein, at the coupled position, the coupling areas rest on one another at a hook-tip inner surface facing the hook arm for the purpose of load transmission, and wherein a respective hook-tip outer surface of one of the first or second coupling areas, which faces away from the respective hook arm, rests on an inner surface of the hook arm of the other one of the first or second coupling area.

14. The buckle according to claim 13, wherein the inner surfaces of each hook tip are oriented obliquely to the load direction of the buckle at the coupled position at a hooking angle, and wherein the hooking angle is an angle between 40° and 85°.

15. A buckle for releasable load coupling of two elements comprising:

a first buckle component and a second buckle component configured for releasable engagement at a coupled position;

said first buckle component having a first connection area for connecting said first buckle component to a first element of said two elements, and a first coupling area including a first hook profile extending a width direction;

said second buckle component having a second connection area for connecting said second buckle component to a second element of said two elements, and a second coupling area including a second hook profile extending in said width direction;

a locking element for releasably locking said first buckle component to said second buckle component when said first buckle component and said second buckle component are at said coupled position, wherein said first hook profile and said second hook profile are complementary and interengage at said coupled position to couple said first buckle component to said second buckle component in a form-fit manner; and wherein, at the coupled position, said first buckle component and said second buckle component are automatically locked to one another by the locking element; and wherein the locking element is an elastic element and first undergoes deformation during insertion of the two hook profiles into one another, and then snaps back into a locked position at the coupled position, and wherein the locking element is adapted to be released without causing a release of the load transmission via the coupling of the first and second buckle components.

16. The buckle according to claim 15, wherein the locking element has an elastic locking arm which locks with at least one locking edge serving as a counterelement, wherein, the locking arm is arranged in an opening in one of said first or second buckle components and having one or more walls serving as the at least one locking edge at said locked position.

17. The buckle according to claim 16, wherein the locking element and the counter element associated with the locking element are arranged centrally in the width direction of the respective buckle components.

18. A buckle for releasable load coupling of two elements comprising:

a first buckle component and a second buckle component configured for releasable engagement at a coupled position;

said first buckle component having a first connection area for connecting said first buckle component to a first element of said two elements, and a first coupling area including a first hook profile extending a width direction;

said second buckle component having a second connection area for connecting said second buckle component to a second element of said two elements, and a second coupling area including a second hook profile extending in said width direction;

a locking element for releasably locking said first buckle component to said second buckle component when said first buckle component and said second buckle component are at said coupled position, wherein said first hook profile and said second hook profile are complementary and interengage at said coupled position to couple said first buckle component to said second buckle component in a form-fit manner;

wherein the locking element has an elastic locking arm which locks with at least one locking edge serving as a counterelement; and wherein the locking arm is disposed on one of the first buckle component or the second buckle component, and the at least one locking edge is disposed on the other one of the first buckle component or the second buckle component.

19. The buckle according to claim 18, wherein the locking engagement of said locking element in said coupled position is adapted to be released by pulling an operating element.

* * * * *